US005485957A

United States Patent [19]

Sturman

[11] Patent Number: 5,485,957

[45] Date of Patent: Jan. 23, 1996

[54] FUEL INJECTOR WITH AN INTERNAL PUMP

[76] Inventor: Oded E. Sturman, 3973 Santa Monica Ct., Newbury Park, Calif. 91320

[21] Appl. No.: 286,641

[22] Filed: Aug. 5, 1994

[51] Int. Cl.[6] ..... F02M 57/02

[52] U.S. Cl. ..... 239/88; 239/73

[58] Field of Search ..... 239/92, 88, 89, 239/95, 96, 91, 533.3, 71, 73

[56] References Cited

U.S. PATENT DOCUMENTS

| | | | |
|---|---|---|---|
| 2,946,513 | 7/1960 | Sampietro | 239/91 |
| 4,046,112 | 9/1977 | Deckard | 239/96 |
| 4,182,492 | 1/1980 | Albert et al. | 239/92 |
| 4,219,154 | 8/1980 | Luscomb | 239/91 |
| 4,405,082 | 9/1983 | Walter et al. | 239/91 |
| 4,605,166 | 8/1986 | Kelly | 239/96 |
| 4,625,918 | 12/1986 | Funada et al. | 239/533.3 |
| 4,770,346 | 9/1988 | Kaczynski | 239/73 |
| 5,143,291 | 9/1992 | Grinsteiner | 239/88 |

*Primary Examiner*—Karen B. Merritt

*Attorney, Agent, or Firm*—Blakely, Sokoloff, Taylor & Zafman

[57] ABSTRACT

A fuel injector that has an integral hydraulically driven mechanically actuated dual action intensifier and a solenoid control valve/spring assembly that accurately controls the movement of the injector intensifier piston, and the amount and timing of fuel ejected by the injector.

16 Claims, 2 Drawing Sheets

FUEL INJECTOR WITH AN INTERNAL PUMP

BACKGROUND OF THE INVENTION

1. Field of the Invention

The present invention relates to a fuel injector for an internal combustion engine.

2. Description of Related Art

Compression ignition (CI) internal combustion engines typically have fuel injectors that eject a highly pressurized stream of fuel into the combustion chamber. Conventional fuel injectors contain an intensifier piston that pressurizes a volume of fuel which is ejected from a nozzle of the injector. The intensifier piston is typically hydraulically driven by a working fluid which pushes the piston and increases the pressure of the fuel. Coupled to the intensifier piston is a spring assembly which moves the piston back to the Original position, where the cycle can be repeated.

It has been found that engine performance and emissions can be improved by Controlling the amount of fuel injected into the combustion chamber. When plotted as a function of flowrate versus time, the fuel injection curve of a conventional fuel injector typically has a bell shape. It is desirable to create a square shaped fuel injection curve, to increase the amount of fuel injected into the combustion chamber and the resultant power generated in the engine.

It has also been found that certain engine characteristics can be improved by pre-injecting fuel into the chamber. The timing of the introduction of the pre-injected fuel is particularly important. Additionally, it is also desirable to provide a square shaped pre-injection curve. It is therefore desirable to provide a fuel injector which can accurately control the timing and quantity of fuel injection.

Fuel injectors may inject fuel at pressures in the order of 10,000 psi. Conventional fuel pumps typically provide the fuel at pressures of approximately 100 psi, thereby requiring an injector compression ratio of 100:1. To reduce the compression ratio of the fuel injector, most CI engines incorporate a booster pump that increases the pressure of the fuel before the fuel is introduced to the fuel injector. Conventional booster pumps are relatively large and occupy an undesirable amount of engine space. It would therefore be desirable to provide a booster pump for a fuel injector that was relatively small in size.

SUMMARY OF THE INVENTION

The present invention is a fuel injector which contains an intensifier piston that is coupled to a spring assembly. The fuel injector has a hydraulically driven mechanically actuated dual action intensifier which receives fuel from a fuel pump and delivers a pressurized fuel to an intensifier chamber. The introduction of the pressurized fuel to the intensifier chamber lifts the piston and compresses the spring assembly. The spring assembly mechanically stores the energy provided by the pressurized fuel. A portion of the pressurized fuel also enters an injection chamber that is coupled to a nozzle of the injector.

The fuel injector contains a solenoid actuated two-way control valve which allows the pressurized fuel within the intensifier chamber to flow to a low pressure return line when the intensifier piston reaches a top dead center position. The reduction of pressure within the intensifier chamber allows the Spring assembly to move the intensifier piston back to the Original position. Movement of the intensifier piston pressurizes the fuel within the injection chamber so that a highly pressurized fuel is ejected from the nozzle of the fuel injector. The fuel injector also contains a position sensor which senses the position of the intensifier piston and controls the operation of the two-way solenoid control valve to control the timing and amount of fuel that is ejected by the injector.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
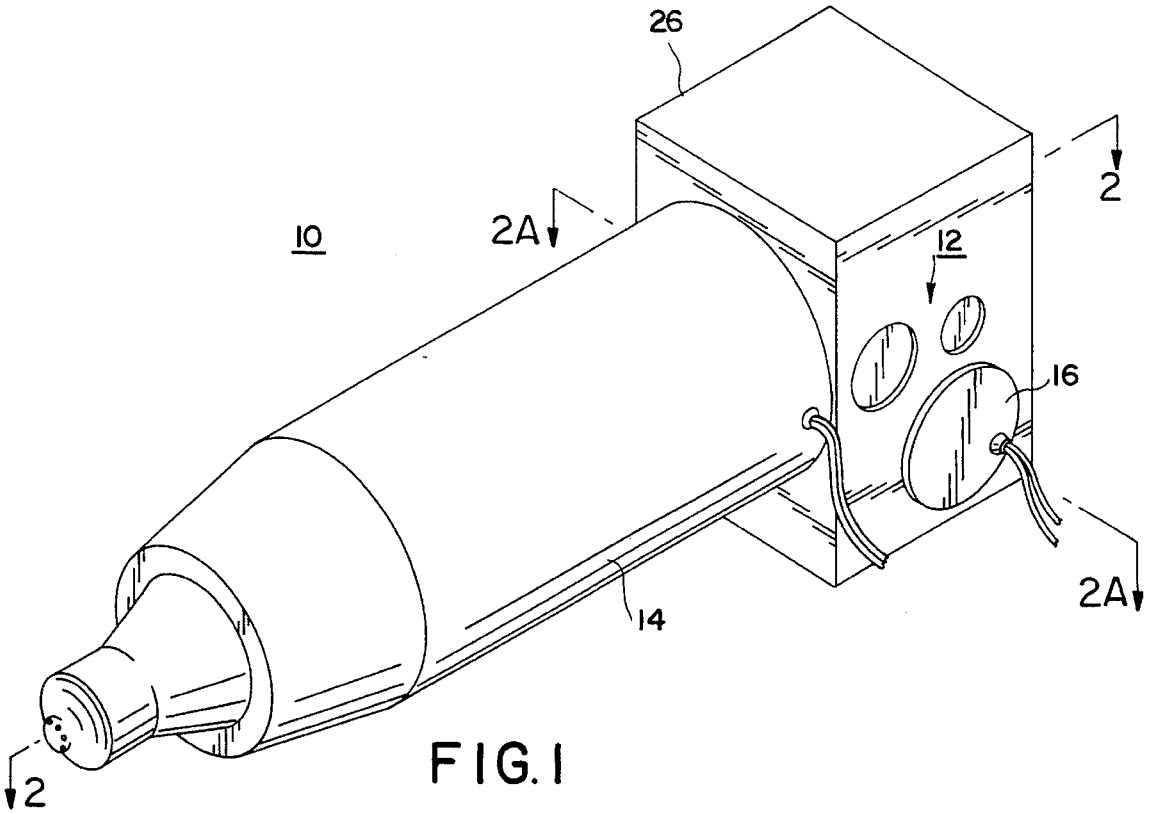
FIG. 1 is a perspective view of a fuel injector of the present invention.

Referring to the drawings more particularly by reference numbers, FIG. 1 shows a fuel injector assembly 10 of the present invention. The assembly 10 includes an intensifier 12 that is coupled to a fuel injector 14. The assembly 10 also contains a control valve 16 that is coupled to the intensifier 12 and the injector 14. The assembly 10 is typically incorporated into a internal combustion engine (not shown) and injects highly pressurized fuel into a combustion chamber of the engine. Although not shown, the assembly 10 has fastening means for attaching the assembly 10 to the engine.

Figure 2A:
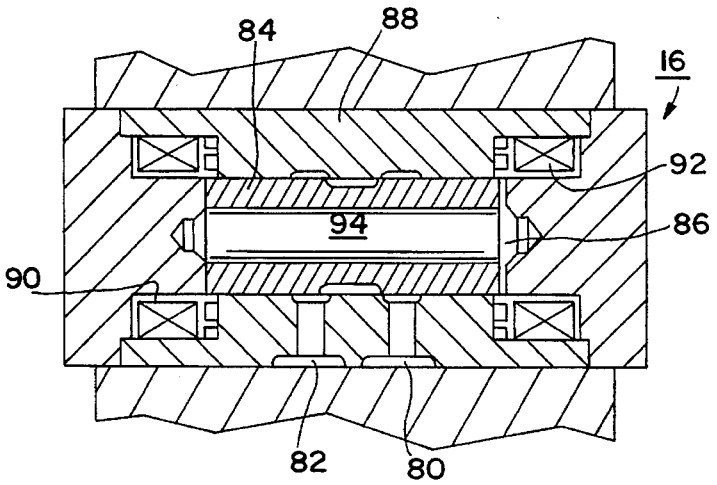
FIG. 2*a* cross-sectional view of a solenoid control valve.
Figure 2:
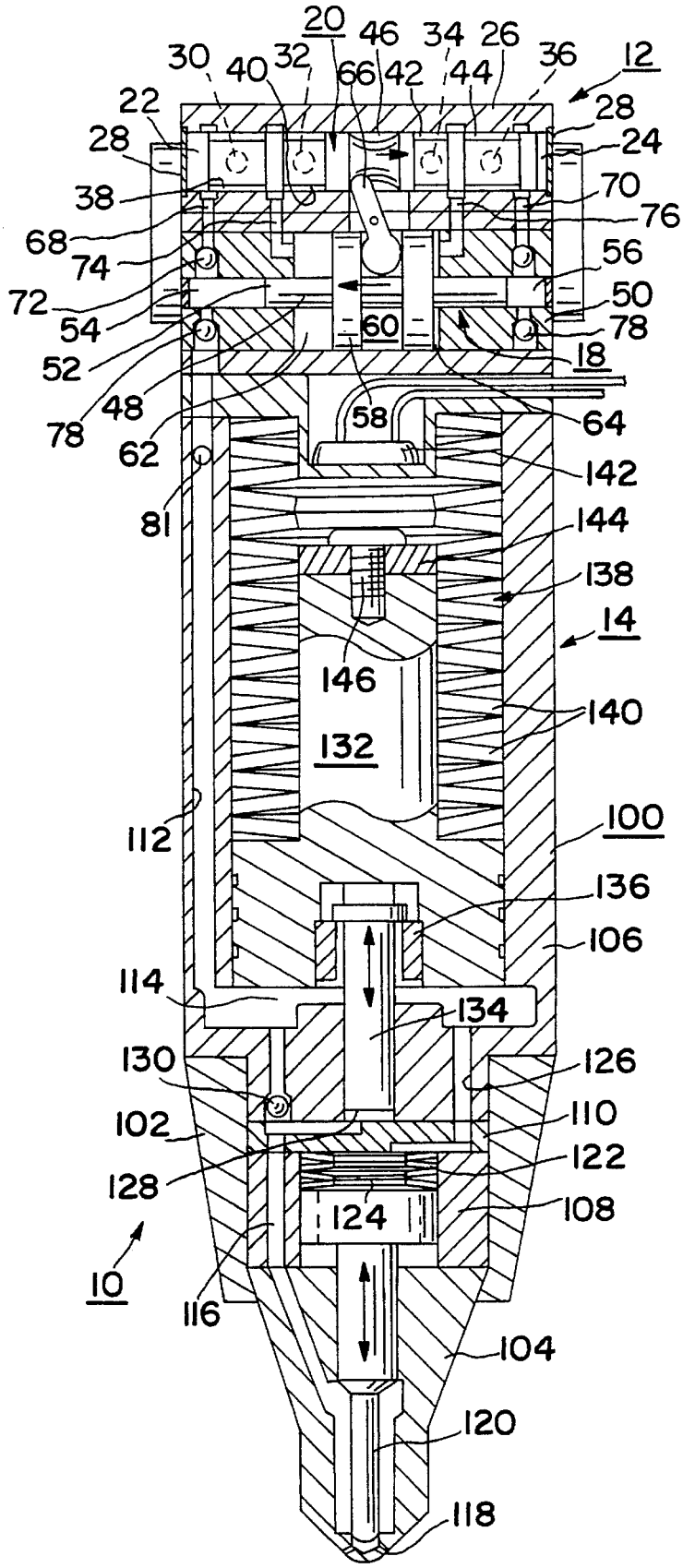
FIG. 2 is a cross-sectional view of the fuel injector of FIG. 1.

As shown in FIG. 2, the intensifier 12 includes an intensifier subassembly 18 and a switch valve subassembly 20. The switch valve subassembly 20 includes a spool 22 that moves within the inner chamber 24 of a housing 26. The housing 26 includes plugs 28 that seal the chamber 24. The housing 26 further contains four ports 30–36. Ports 30 and 36 are coupled to a source of fuel. Ports 32 and 34 are coupled to a low pressure return line. The ports are also coupled to annular grooves 38–44 of the spool 22. At the center of the spool 22 is an annular latch groove 46.

The intensifier subassembly 18 has a first intensifier piston 48 that moves within a housing 50. The intensifier piston 48 has a pair of first heads 52 located within a pair of corresponding pressure chambers 54 and 56, and a pair of second heads 58 located within a control chamber 60. The area ratios of the heads is such that the pressure within the control chamber 60 exerts a force that moves the piston 48 and pressurizes the fuel in chambers 54 and 56 to a level greater than the fuel pressure within chamber 60. The heads 58 divide the control chamber 60 into a first subchamber 62 and a second subchamber 64. The second heads 58 engage a latch 66 that is pivotally connected to the housing 50 and moves the spool 22 of the switch valve 20. The pressure chambers 54 and 56 are coupled to the source of fuel through the spool 22 and feed lines 68 and 70, respectively. Check valves 72 prevent a back flow of fuel from the pressure chambers 54 and 56. Subchamber 62 is coupled to the supply port 30 or return port 32 through the spool 22 and line 74. Subchamber 64 is coupled to the return port 34 or the supply port 36 through the spool 22 and line 76. The pressure chambers 54 and 56 provide fuel to the fuel injector through check valves 78.

In operation, as shown in FIG. 2, the spool 22 is in a position wherein the spool 22 couples subchamber 62 to the return port 32 and subchamber 64 to supply port 36. Additionally, there,is a volume of fuel in pressure chamber 54. Pressure chamber 56 is coupled to supply port 36. The supply port 36 provides fuel to chamber 56. The pressurized fuel provided from the fuel port 36 to the subchamber 64 moves the piston 48 so that the pressure head 52 reduces the volume of pressure chamber 54 and increases the pressure of the fuel therein. The area ratios between the heads is such that there is a significant increase in the pressure of the fuel. By way of example, the fuel may be introduced to the pressure 54 and control 58 chambers at a pressure of approximately 100 psi and be pressurized by the intensifier piston 48 to a pressure of approximately 3000 psi.

As the piston 48 is moving, the heads 58 rotate the latch 66 in a clockwise direction within the annular groove 46 of the spool 22. The movement of the piston 48 also increases the volume of the pressure chamber 56 which receives fuel from supply port 36. The piston 48 moves until the latch 66 engages the spool 22 and moves the spool 22 in the direction indicated by the arrow. Spool movement couples the subchamber 62 to supply port 30 and subchamber 64 to return port 34, wherein fuel flows into subchamber 62 to move the piston 48 in the opposite direction to pressurize the fuel within pressure chamber 56. Piston 48 movement continues until the latch 66 moves the spool 22 back to the original position wherein the process is repeated.

As shown in FIG. 2*a*, the control valve 16 is preferably a two-way solenoid controlled valve that has a first port 80 coupled to a return port 81 of the fuel injector 14 and a second port 82 connected to a low pressure return line. The control valve 16 contains a spool 84 that moves within an inner chamber 86 of a housing 88. The spool 84 has an annular groove that prevents fluid communication between the first 80 and second 82 ports when in a first position and provides fluid communication between the return port of the fuel injector and the low pressure return line when in a second position. The spool 84 is moved by a pair of solenoids 90 and 92 that are connected to an electrical control system (not shown). Energizing solenoid 90 moves the spool 84 into the first position. Energizing solenoid 92 moves the spool 84 into the second position.

The housing 88 and spool 84 are preferably constructed from a magnetic material such as a 4140 hardened steel. The magnetic properties of the steel are such that the hysterisis of the material maintains the position of the spool 84. Using a magnetic steel allows the valve 16 to be operated in a digital manner, wherein a solenoid is energized to move the spool and then de-energized when the spool 84 has reached the desired position.

Fuel may leak into the inner chamber 86 and create an hydrostatic pressure which counteracts the movement of the spool. The counteracting hydrostatic pressure may slow down the response time of the valve. The spool 84 preferably has an inner passage 94 that allows fuel to flow from one end of the spool 84 to the other end to prevent the build up of hydrostatic pressure within the inner chamber 86.

In operation, the second solenoid 92 is energized to move the spool 84 to the second position. The solenoid 92 is de-energized when the spool 84 reaches the new position. The spool movement provides fluid communication between the first port 80 and the second port 82. The first solenoid 90 is then energized to move the spool 84 back to the original position, wherein the spool 84 blocks fluid flow through the valve. The solenoid 90 is de-energized when the spool 84 moves back to the original position.

The fuel injector 14 has a housing 100 that includes an end cap 102 that captures a nozzle member 104 and is attached to an upper housing 106. Within the end cap 102 are injection housing members 108 and 110. The housing 100 may further include seals (not shown) that seal the unit.

The upper housing 106 contains a fuel passage 112 that is in fluid communication with an intensifier chamber 114 and the pressure chambers 54 and 56 of the intensifier 14. The fuel passage 112 is also coupled to the control valve through the return port 81. The intensifier chamber 114 is in fluid communication with a second fuel passage 116 that extends through the housing members 108 and 110, and the nozzle 104. The nozzle 104 contains a plurality of openings 118 that are coupled to the second fuel passage 116. The flow of fuel through the nozzle openings 118 is controlled by a needle valve 120. The needle valve 120 is biased into a closed position by nozzle springs 122 located within a nozzle spring chamber 124. The nozzle chamber 124 is coupled to the intensifier chamber 114 through passage 126 to prevent a hydrostatic build up of pressure in the chamber 124 that will counteract the movement of the needle valve 120. The second fuel passage 116 is connected to an injector chamber 128 that receives fuel from the intensifier 12. The second passage 116 has a check valve 130 which prevents fuel from flowing back into the intensifier chamber 114.

Located within the upper housing 106 is a second intensifier piston 132 that has an intensifier 134 which moves within the injector chamber 128. The intensifier 134 is captured by an insert 136 that is attached to the piston 132.

Coupled to the piston 132 is a spring assembly 138. In the preferred embodiment, the spring assembly 138 comprises a plurality of individual springs 140 assembled in the arrangement shown in FIG. 2. Although Belleville springs are shown and described, it is to be understood that other types of springs can be used. It is preferable to provide a spring assembly that has a linear force versus deflection characteristic.

The area ratio of the piston 132 and the intensifier 134 is such that the fuel within injector chamber 128 is pressurized to a value higher than the fuel pressure within the intensifier chamber 116. By way of example, the intensifier 134 can increase the fuel pressure from 3000 psi to approximately 10,000 psi.

The injector 14 further contains a position sensor 142 that is coupled to a magnet 144 located at the top of the intensifier piston 132. The magnet 144 is attached to the piston 132 by pin 146. The sensor 142 provides feedback signals to the electronic controls that energizes the solenoids of the control valve 16. When the piston 132 reaches a top dead center position, the sensor 142 provides a feedback signal which causes the electronic controls to energize the solenoid 92 to open the valve and allow fuel to flow from the intensifier chamber 116. When the piston 132 reaches a fully stroked position, the sensor 142 provides a feedback signal which causes the solenoid 90 to be energized to terminate the flow of fuel out of the chamber 116.

In operation, the intensifier 12 provides a pressurized fuel to the intensifier chamber 116. The pressurized fuel lifts the intensifier piston 132 and compresses the spring assembly 138. The Spring assembly stores the energy generated by the intensifier 12 and provided by the pressurized fuel. The fuel also flows from the intensifier 12 into the injector chamber 128. When the piston 132 reaches a top dead center position, the control valve 16 is opened to allow fuel to flow out of the intensifier chamber 116. The flow of fuel reduces the pressure in the chamber 116 and allows the Spring assembly 138 to move the piston 132 back to the original position. Movement of the piston 132 also moves the intensifier 134, which reduces the volume of the injector chamber 128 and increases the pressure of the fuel therein. The highly pressurized fuel lifts the needle valve 120 and is ejected through the nozzle openings 118. When the piston 132 reaches the fully stroked position, the control valve 16 is closed and the pressure within the intensifier chamber 128 is increased by the intensifier 12, wherein the process is repeated.

The combination of the control valve 16 and the spring assembly 138 provides a fuel injector that precisely controls the timing of fuel ejection. Additionally, the fuel injector 14 of the present invention can more accurately control the volume of fuel that is ejected each cycle.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fuel injector, comprising:

a housing which has a fuel port that receives a fuel, a nozzle opening that ejects fuel and a return port that allows fuel to flow out of said housing;

an intensifier that moves between a first position and a second position to increase a pressure of the fuel that is ejected from said housing;

a control valve that controls fuel flow between said intensifier and said return port;

a pressure device that supplies fuel that moves said intensifier to the first position; and, a spring that moves said intensifier to the second position and pressurizes the fuel when said control valve allows fuel to flow m out of said return port.

2. The fuel injector as recited in claim 1, wherein said control valve is a two-way valve that opens and closes said return port.

3. The fuel injector as recited in claim 2, wherein said control valve has a pair of solenoids that move a valve spool between a first position that opens said return port and a second position that closes said return port.

4. The fuel injector as recited in claim 3, further comprising a position sensor operatively connected to said intensifier to sense the first and second positions of said intensifier and provide feedback signals to said control valve to switch said solenoids such that said valve spool moves to the first position when said intensifier is at the first position and said valve spool moves to the second position when said intensifier is at the second position.

5. The fuel injector as recited in claim 1, wherein said pressure device is a piston that is coupled to said fuel port and which moves between a first position and a second position to pressurize the fuel.

6. The fuel injector as recited in claim 5, wherein fluid communication between said fuel port and said piston is controlled by a spool that is moved by an hydraulically driven latch and said piston.

7. The fuel injector as recited in claim 1, further comprising a needle valve that control the flow of fuel through said nozzle opening, said needle valve moving between a first position to open said nozzle opening and a second position to close said nozzle opening.

8. The fuel injector as recited in claim 7, further comprising a needle spring that biases said needle valve into the second position.

9. A fuel injector, comprising:

a housing which has a fuel port that receives a fuel, a nozzle opening that ejects fuel, a return port that allows fuel to flow out of said housing, an intensifier chamber that is coupled to said fuel port and said return port and a injection chamber coupled to said fuel port and said nozzle opening;

a pressure device that supplies a pressurized fuel to said intensifier chamber and said injection chamber;

an intensifier that moves to a first position when the pressurized fuel is introduced to said intensifier chamber;

a control valve that allows the pressurized fuel to flow through said return port when in an open position;

a spring assembly that moves said intensifier to a second position and pressurizes the fuel when said control valve is in the open position.

10. The fuel injector as recited in claim 9, wherein said control valve is a two-way valve that opens and closes said return port.

11. The fuel injector as recited in claim 10, wherein said control valve has a pair of solenoids that move a valve spool between a first position that opens said return port and a second position that closes said return port.

12. The fuel injector as recited in claim 11, further comprising a position sensor operatively connected to said intensifier to sense the first and second positions of said intensifier and provide feedback signals to said control valve to switch said solenoids such that said valve spool moves to the first position when said intensifier is at the first position and said valve spool moves to the second position when said intensifier is at the second position.

13. The fuel injector as recited in claim 9, wherein said pressure device is a piston that is coupled to said fuel port and which moves between a first position and a second position to pressurize the fuel.

14. The fuel injector as recited in claim 13, wherein fluid communication between said fuel port and said piston is controlled by a spool that is moved by an hydraulically driven latch and said piston.

15. The fuel injector as recited in claim 9, further comprising a needle valve that controls the flow of fuel through said nozzle opening, said needle valve moving between a first position to open said nozzle opening and a second position to close said nozzle opening.

16. The fuel injector as recited in claim 15, further comprising a needle spring that biases said needle valve into the second position.

* * * * *